United States Patent [19]

High

[11] 4,071,248

[45] Jan. 31, 1978

[54] PUZZLE APPARATUS

[76] Inventor: Carl E. High, 110 Sullivan St., New York, N.Y. 10012

[21] Appl. No.: 739,795

[22] Filed: Nov. 8, 1976

[51] Int. Cl.[2] ..... A63F 9/08

[52] U.S. Cl. ..... 273/155

[58] Field of Search ..... 273/155, 157 A; 46/29, 46/30, 31; 40/102.04; 281/16

[56] References Cited

U.S. PATENT DOCUMENTS

| | | | |
|---|---|---|---|
| 942,536 | 12/1909 | Bartsch | 273/155 |
| 1,155,035 | 9/1915 | Bostwick | 46/29 |
| 2,280,682 | 4/1942 | Baker | 40/104.02 X |
| 3,892,411 | 7/1975 | High | 273/155 |

FOREIGN PATENT DOCUMENTS

| | | | |
|---|---|---|---|
| 21,867 | 10/1907 | United Kingdom | 273/157 A |

*Primary Examiner*—Anton O. Oechsle

[57] ABSTRACT

Puzzle apparatus having a square playing area defined by a square pivot frame each side of which carries a plurality of strip members pivotally mounted for movement against said area in overlying relationship and interleaved with one another to provide a preselected solution sequence. The strip members have spaced recesses along their respective lengths providing lateral and endwise legs defining a plurality of L-shaped contiguous portions each having three discrete identifiable sub-areas thereby providing a multiplicity of selectable puzzle solutions.

10 Claims, 11 Drawing Figures

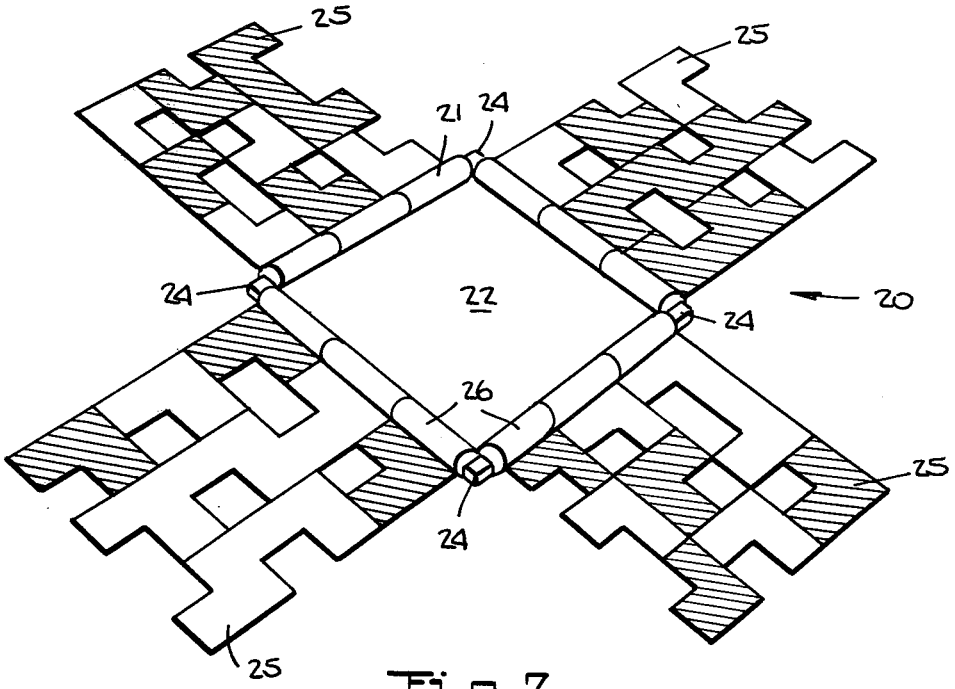
Fig. 7.
Fig. 8.
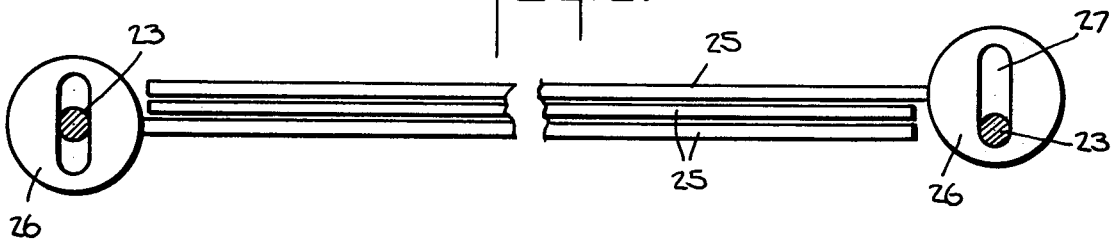
Fig. 9.
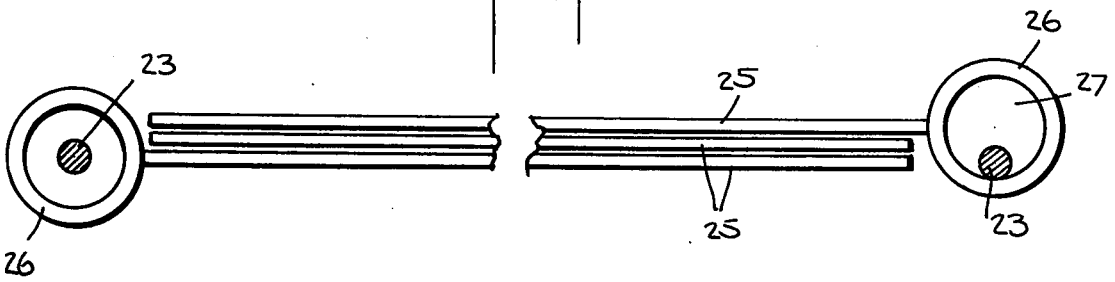

PUZZLE APPARATUS

BACKGROUND OF THE INVENTION

Puzzles with overlapping strip members arranged around the edges of a square playing surface and deployable against the surface in a preselected order to achieve a puzzle solution were known in the prior art. The present inventor was issued U.S. Pat. No. 3,892,411 for one such puzzle which involved a plurality of transparent strip members with indicia thereon that provided a puzzle solution wherein the respective indicia in the overlapped strips were disposable in a preselected alternating sequence. While such patented puzzle had unique properties in comparison with those known before its conception, the utility of such puzzle apparatus had its limitations.

The desire existed, even after the just mentioned patented invention, for a similar type of puzzle that had inherent multiple solution sequences even in a specific indicia-bearing form of the puzzle, as well as a puzzle having a discrete form which could be used to make puzzle solutions of widely different character and degree of difficulty in achievement.

BRIEF SUMMARY OF THE INVENTION

The present invention is an improved puzzle apparatus comprising a frame defining a substantially square base playing area constituted by an axle member disposed along each side of said area, the axle members joined at their adjacent ends by socket members defining the corners of the area. Each axle carries a similar plurality of strip members in side-by-side relation which are adapted to interleave with one another to cover said area in a particular solution sequence based on the arrangement of discrete identifiable portions on the respective strip members.

Each strip member in the present apparatus has an elongated body portion comprised of a succession of contiguous, seemingly randomly oriented L-shaped portions each such portion providing discrete identifiable sub-areas and thereby a multiplicity of puzzle solution objectives.

Other objects and features of the invention will become apparent in the following description and claims and in the drawings.

DESCRIPTION OF THE DRAWINGS

FIG. 3 is a bottom plan view of the device shown in FIG. 2;

FIG. 7 is an isometric view of the preferred mechanical arrangement of a puzzle according to the present invention;

FIG. 9 is an enlarged fragmentary elevation in partial section of another form of axle member;

DESCRIPTION OF THE PREFERRED EMBODIMENT

Figure 1:
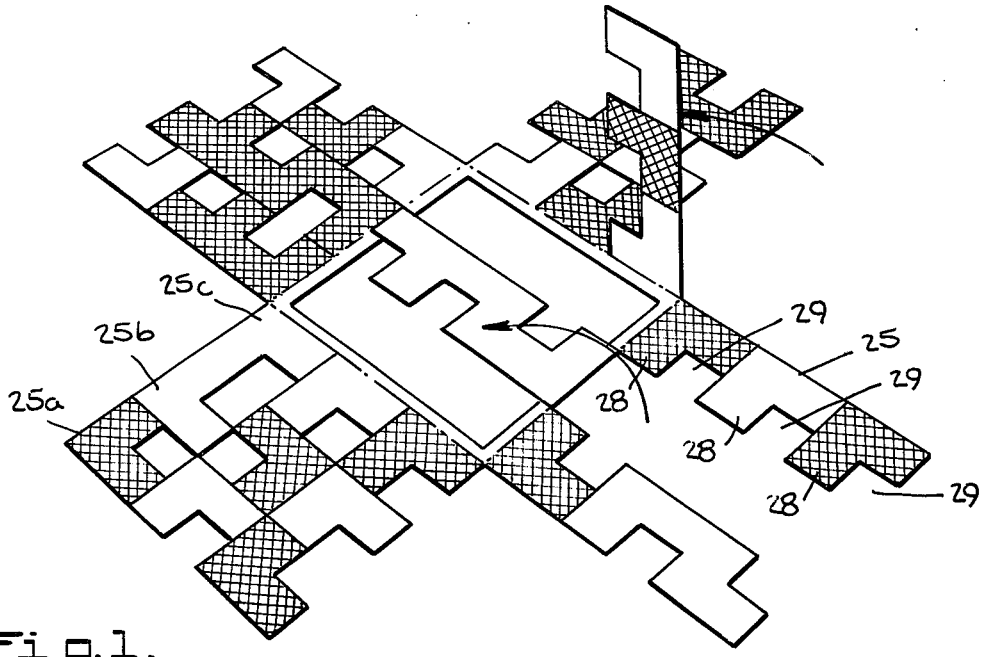
FIG. 1 is an isometric view of one embodiment of the invention.

Referring now to the drawings, particularly FIG. 7, puzzle apparatus according to the present invention is designated generally by reference numeral 20 and is comprised of a square frame 21 defining a substantially square base playing area 22. Said frame includes an axle member 23 axially disposed along each side of said area (see FIG. 8, 9) and joined at its ends to adjacent axle members by socket members 24 which define the corners of said area. A plurality of strip members 25, each having an enlarged tubular hub 26 at one end thereof, are pivotally mounted at said hubs on said axles as shown to provide a corresponding plurality of pivotal strip members on each side of said playing area 22.

Figure 8:
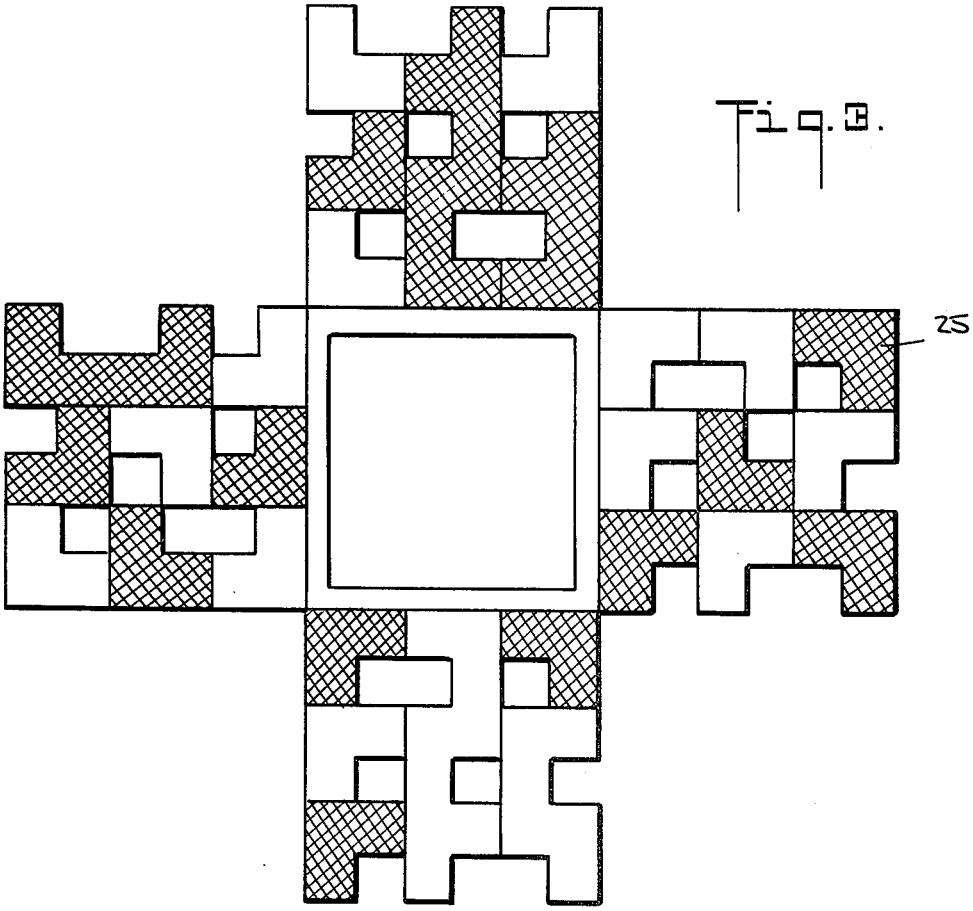
FIG. 8 is an enlarged fragmentary elevation in partial section of one form of axle member.

As shown in FIG. 8, one embodiment of hub 26 has an elongated bore cross-section 27 permitting relative motion between axle 23 and hub 26 when the respective strip members over-lie one another to permit the interleaved strip members to lie flat against one another over said area 22.

Figure 4:
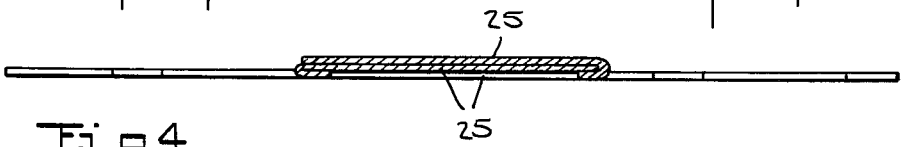
FIG. 4 is a section taken along lines 4—4 of FIG. 2.

In the embodiment shown in FIG. 9, the hub 26 has a bore cross-section 27 substantially larger than the diameter of axle 23 again permitting the overlying strip members 25 to lie flat in the closed position over area 22 (see also FIG. 4).

Figure 2:
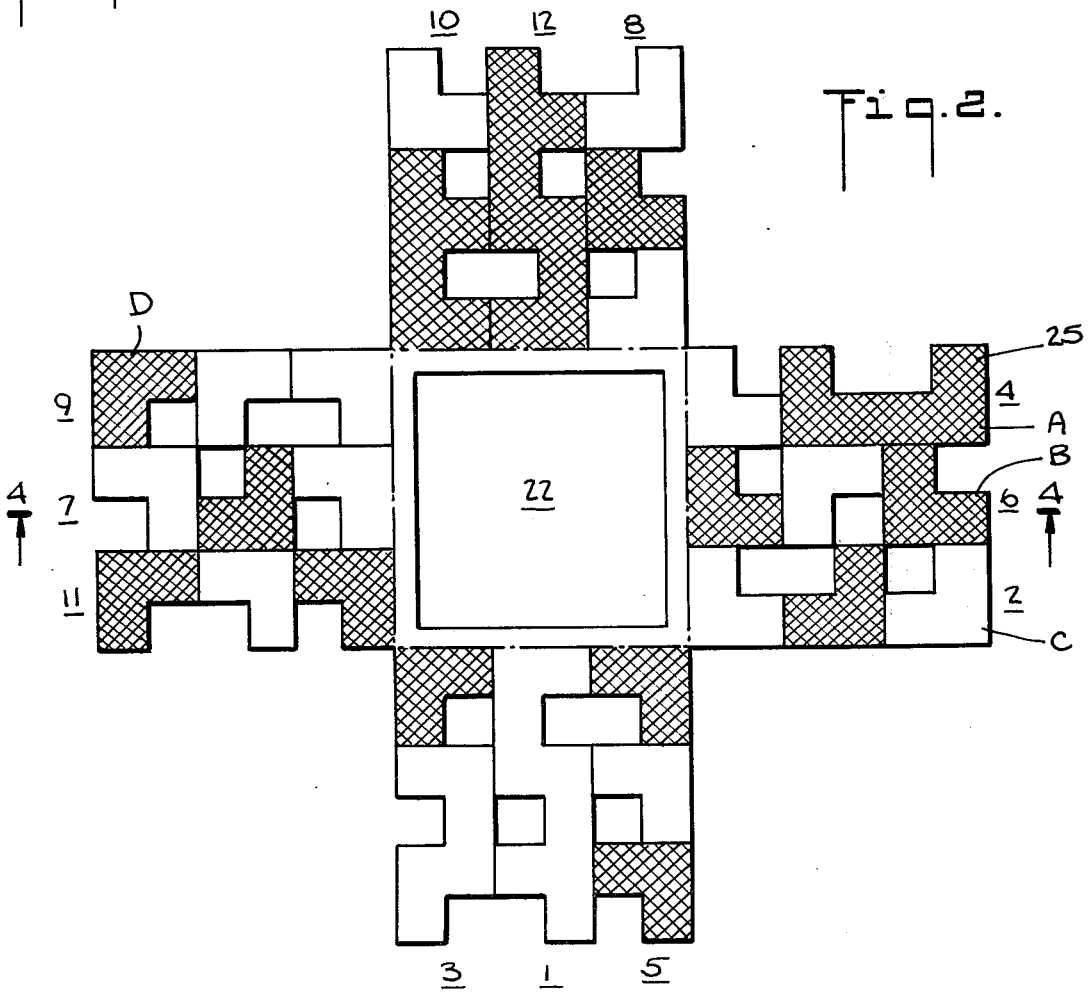
FIG. 2 is a top view of the embodiment shown in FIG. 1 in the open position.

As can be seen by reference to FIGS. 1–3, each strip member 25 has a generally rectangular body and a plurality of spaced rectangular projections 28 thereon defined by rectangular cutaway portions 29 providing, in effect, a plurality of contiguous L-shaped portions on each strip. As can be seen from the FIGURES each strip on a given axle is geometrically dissimilar from the other strips on the same axle as well as from the corresponding strip on the opposite side of the playing area. Referring by way of example to FIG. 2, strip A is geometrically dissimilar from its associated strips B and C as well as from strip D on the opposite side of the playing area 22. The same geometric dissimilarity prevails on all sides of the playing area.

Figure 11:
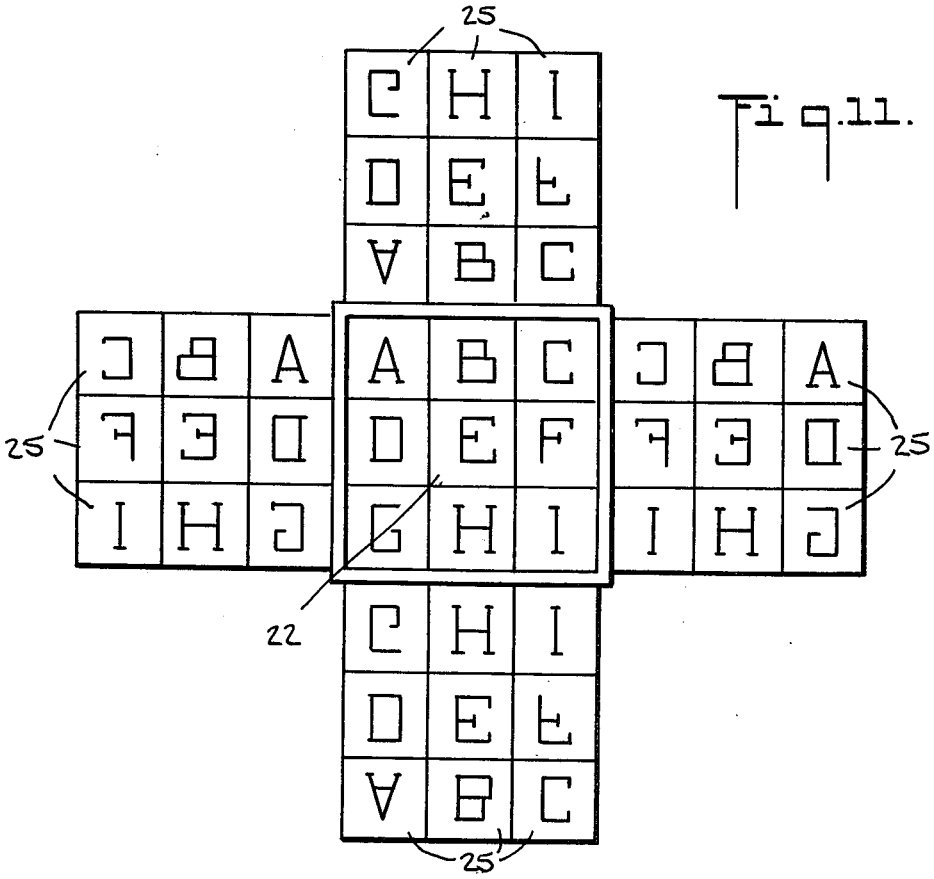
FIG. 11 is a schematic diagram showing the common areas of the strips that are movable adjacent one another in the interleaved position.

As shown in FIG. 11, different relative portions of the strips are movable into alignment with the portions of the other strips. Playing area 22 as shown has been divided into nine square areas lettered alphabetically from A through I and the corresponding strip areas have been similarly lettered to designate the solution areas that are adapted for providing various solution objectives.

Figure 10:
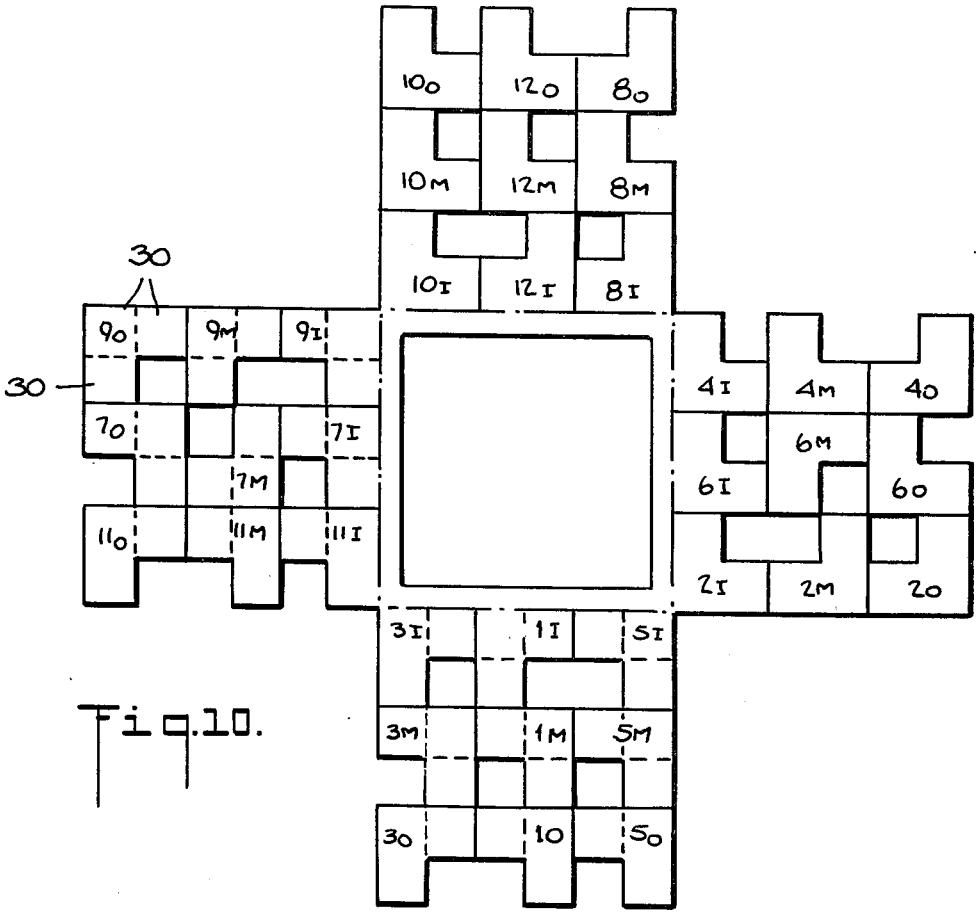
FIG. 10 is a schematic representation of puzzle apparatus according to the present invention showing the discrete sub-areas of the strip member.

More specifically, as shown in FIG. 10, each lettered area of FIG. 11, by virtue of the recessed form of applicant's strip members provides three square sub-areas 30 which multiply the discrete identifiable portions on each strip member and thereby multiplies the number of the potential solution objectives for the puzzle.

Figure 5:
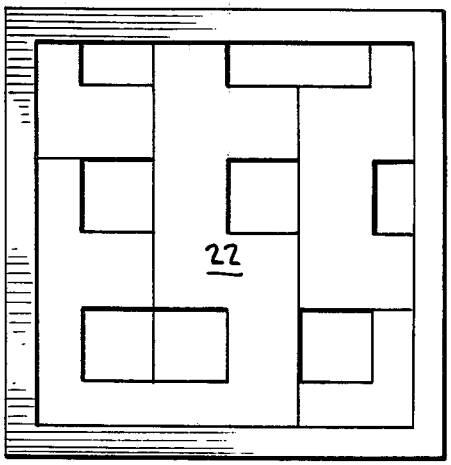
FIG. 5 is a bottom plan view of one embodiment of the invention in the closed position.
Figure 6:
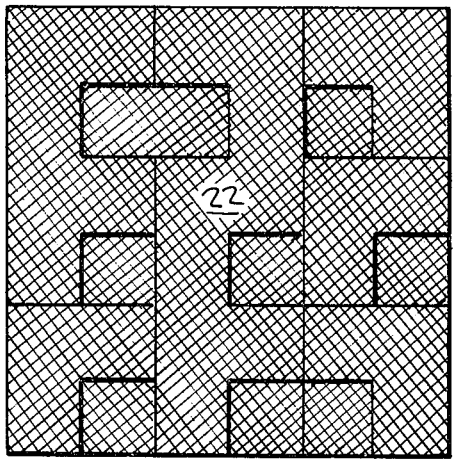
FIG. 6 is a top plan view of the device shown in FIG. 5 in the close position.

In the specific form of apparatus shown in FIGS. 1–7, each L-shaped area 25*a*, 25*b* and 25*c* are delineated by one of two predetermined colors and one solution objective can be as shown in FIGS. 5 and 6, namely, playing area 22 will be completely covered by one of the two colors on the bottom (FIG. 5) and be completely covered by the other of the two colors on the top (FIG.

6). It is possible with the same color arrangement to include a solution objective whereby there are alternating adjacent colors within the interleaved strip members.

The solution objective possibilities with the present apparatus are virtually unlimited and various types of indicia may be employed, various types of colors, etc. and utilization of the sub-areas 30 of each strip member 25 in a differentiated pattern provides multiple possibilities of solutions and varying degrees of solution difficulties.

The puzzle may be fabricated from any suitable material such as plastic, e.g., polyethylene, polypropylene, styrene, etc. The plastic may be transparent, translucent or opaque as desired. The parts such as the axles and sockets may be joined together by any suitable adhesive, cement or thermal joining techniques, all well-known.

It is apparent from the above description that the present puzzle utilizes strip members, the shape of which is an inherent part of the solution objective. It also should be apparent that the utility of the present puzzle is virtually unlimited in providing a wide number of variations.

While certain embodiments of the invention have been shown and described, it is to be understood that changes and additions may be made by those skilled in the art without departing from the scope and spirit of the invention.

I claim:

1. Puzzle apparatus comprising a frame defining a substantially square base playing area, said frame including a plurality of axle members, one each axially disposed along a respective side of said area, a plurality of socket members joining adjacent ends of said axle members to define the corners of said area, a plurality of strip members each having a mounting hub at one end thereof pivotally attached at said hub to a respective one of said axle members in side-by-side relation to other strip members to provide a corresponding number of strips on each axle member, said strips being adapted to be interleaved with one another to cover said area in overlying relationship to provide a preselected solution sequence determined by a particular interleaved pattern, said hub of each strip member being adapted for relative pivotal and longitudinal movement of said strip members with respect to said axle members when said strip members are interleaved in said overlying relationship to permit said interleaved strip members to lie flat against one other in said overlying relationship.

2. In the puzzle apparatus of claim 1, each said strip member having a generally rectangular body comprising a plurality of spaced rectangular projections defined by rectangular cutaway portions, said strip members being adapted to be interleaved with one another in overlying relationship to cover said area in a preselected pattern with each said body and its said projections.

3. In the puzzle apparatus of claim 1, each said strip member having a generally rectangular body and a plurality of spaced rectangular side projections defined by rectangular cutaway portions along at least one of the sides thereof, said strip members being adapted to be interleaved with one another in overlying relationship to cover said area in a preselected pattern with each said body and its side projections.

4. In the puzzle apparatus of claim 3, said strip members each having discrete identifiable portions associated with said projections to provide said solution sequence.

5. In the puzzle apparatus of claim 4, said strip members each having discrete identifiable portions associated with both sides of said projections to provide a solution sequence on both top and bottom surfaces of said playing area.

6. In the apparatus of claim 4, each said hub having a mounting bore extending therethrough adapted to receive its respective axle members said bore being substantially larger in cross-section to permit relative movement of said axle member and said hub in relation to said area.

7. In the apparatus of claim 6, each said hub having a mounting bore extending therethrough adapted to receive its respective said axle member, said bore being elongated in cross-section to permit perpendicular relative movement of said axle member and said hub in relation to said area.

8. Puzzle apparatus according to claim 7 in which each strip member mounted on a given one of said axle member is dissimilar in shape with respect to any adjacent strip member.

9. Puzzle apparatus according to claim 8 in which each strip member is dissimilar in shape from the corresponding strip member mounted on the opposite side of said playing area.

10. Puzzle apparatus according to claim 9 in which each said strip member is comprised of three L-shaped portions each providing three descrete identifiable rectangular areas bearing a specific relation to a preselected solution objective.

* * * * *

UNITED STATES PATENT AND TRADEMARK OFFICE

CERTIFICATE OF CORRECTION

PATENT NO. : 4,071,248

DATED : January 31, 1978

INVENTOR(S) : CARL E. HIGH

It is certified that error appears in the above-identified patent and that said Letters Patent are hereby corrected as shown below:

Col. 1, line 52 after "top" insert --plan--.

Col. 4, line 40 change "member" to --members--.

Col. 4, line 48 change "descrete" to --discrete--.

Signed and Sealed this

Sixteenth Day of May 1978

[SEAL]

*Attest:*

RUTH C. MASON
*Attesting Officer*

LUTRELLE F. PARKER
*Acting Commissioner of Patents and Trademarks*